US005674054A

United States Patent [19]

Ota et al.

[11] Patent Number: 5,674,054

[45] Date of Patent: Oct. 7, 1997

[54] RECIPROCATING TYPE COMPRESSOR

[75] Inventors: Masaki Ota; Yasunori Makino; Sokichi Hibino; Hisakazu Kobayashi, all of Kariya, Japan

[73] Assignee: Kabushiki Kaisha Toyoda Jidoshokki Seisakusho, Kariya, Japan

[21] Appl. No.: 373,194

[22] PCT Filed: May 20, 1994

[86] PCT No.: PCT/JP94/00816

§ 371 Date: Jan. 17, 1995

§ 102(e) Date: Jan. 17, 1995

[87] PCT Pub. No.: WO94/28305

PCT Pub. Date: Aug. 12, 1994

[30] Foreign Application Priority Data

| | | | |
|---|---|---|---|
| May 21, 1993 | [JP] | Japan | 5-119969 |
| Jul. 8, 1993 | [JP] | Japan | 5-169282 |
| Mar. 31, 1994 | [JP] | Japan | 6-062942 |

[51] Int. Cl.[6] ..... F04B 1/12

[52] U.S. Cl. ..... 417/269; 91/499; 417/540

[58] Field of Search ..... 417/222.2, 269, 417/222.1, 540; 91/499

[56] References Cited

U.S. PATENT DOCUMENTS

| | | | |
|---|---|---|---|
| 2,160,978 | 6/1939 | Mock | 417/269 |
| 3,712,759 | 1/1973 | Olson, Jr. | 417/269 |
| 3,734,647 | 5/1973 | Sparks | 417/269 |
| 4,221,544 | 9/1980 | Ohta | 417/269 |
| 4,392,788 | 7/1983 | Nakamura et al. | 417/269 |
| 4,544,332 | 10/1985 | Shibuya | 417/269 |
| 4,801,248 | 1/1989 | Tojo et al. | 417/269 |
| 5,051,067 | 9/1991 | Terauchi | 417/269 |
| 5,286,172 | 2/1994 | Taguchi | 417/270 |
| 5,332,365 | 7/1994 | Taguchi | 417/270 |
| 5,507,627 | 4/1996 | Okazaki | 417/269 |

FOREIGN PATENT DOCUMENTS

| | | | |
|---|---|---|---|
| 3731944 A1 | 4/1988 | Germany | 417/222.2 |
| 58-7835 | 2/1983 | Japan . | |
| 1-113164 | 7/1989 | Japan . | |
| 4-125680 | 11/1992 | Japan . | |

*Primary Examiner*—Timothy Thorpe
*Assistant Examiner*—Peter G. Korytnyk
*Attorney, Agent, or Firm*—Burgess, Ryan & Wayne

[57] ABSTRACT

A reciprocating type compressor including a cylinder block (1), a cylinder head (3) joined to the outer end of the cylinder block (1) and provided with a discharge chamber (**3*b*) or a suction chamber and a valve plate (4) held between the cylinder block (1) and the cylinder head (3) has an auxiliary discharge chamber (16) (or an auxiliary suction chamber) formed in a portion of the cylinder block (1) surrounded by an arrangement of cylinder bores (1*a*) formed in the cylinder block (1), and the auxiliary discharge chamber (16) (or the auxiliary suction chamber) is communicated with the discharge chamber (3*b*) (or the suction chamber) by means of at least one through-hole (17) to reduce the discharge pressure pulsation or suction pressure pulsation to thereby reduce the vibration of the gas-conduit line and, when the compressor is incorporated into an climate control system of a vehicle, to reduce noise in the passenger compartment. The auxiliary discharge chamber (16**) (or the auxiliary suction chamber) may be connected to a discharge passage (or a suction passage) by an outlet through-hole (or an inlet through-hole).

17 Claims, 11 Drawing Sheets

RECIPROCATING TYPE COMPRESSOR

BACKGROUND OF THE INVENTION

1. Field of the Invention

The present invention relates to a reciprocating type compressor in which suction, compression and discharge of a refrigerant are implemented by the reciprocation of pistons. More particularly, it relates to a reciprocating type compressor, suitable for use in a climate control system, which can compress a refrigerant gas.

2. Prior Art

Wobble-plate type and swash-plate type compressors, in which reciprocating pistons slidably is fitted in a plurality of respective cylinder bores formed in a cylinder block are reciprocated at different respective phases via a swash plate, are generally known and are, frequently applied to automotive climate control systems.

A pulsation of the discharge pressure has been a problem in the compressor of this kind. When the compressor is incorporated into an automotive climate control system, the pulsation of the discharge pressure propagates through a gas-conduit to a condenser, causing the condenser and the associated conduit to vibrate and, consequently, noise is generated inside the vehicle.

Generally, the pulsating discharge pressure that propagates from the discharge chamber of the compressor to the gas-conduit has a direct component that propagates from the cylinder bores directly to the conduit, and complex indirect components, in a wide frequency band, that is generated in the discharge chamber owing to the shape etc. of the discharge chamber. The direct component of the pulsating discharge pressure produced in the cylinder bore nearer to the gas-conduit generates greater noise. The frame of the vehicle resonates to the indirect components of the vehicle and amplifies the noise when the natural frequency of the frame or the like of the vehicle falls in the frequency band of the indirect component.

In the conventional automotive climate control system, a muffler is provided in a gas-conduit connecting the discharge chamber of the compressor to the condenser so as to suppress the generation of noise attributable to vibration of the condenser.

Nevertheless, any muffler provided in the gas-conduit requires additional space for mounting the muffler in the vehicle, and it has become difficult to install the muffler in the engine compartment of recent vehicles in which parts are densely arranged.

Since the pulsating discharge pressure is inversely proportional to the volume of the discharge chamber, the muffler may be omitted after increasing the volume of the discharge chamber relative to the volume of the cylinder bores. However, an expansion of the discharge chamber entails an increase in the size of the compressor, which, like the placement of the muffler in the gas-conduit, causes a problem regarding available space.

Even if the volume of each discharge chamber of a compressor is increased so as to suppress the discharge pressure pulsation, the direct component that propagates directly from the cylinder bores of the compressor to the gas-conduit and, particularly, the pulsation attributable to the cylinder bores near the conduit, cannot be appreciably reduced and propagates to the gas-conduit, the equipment in a vehicle then resonates due to the indirect component when the respective natural vibration frequencies of the equipment coincide with the frequency of the indirect component of the discharge pulsation and, therefore, the noise that prevails in the passenger compartment cannot be effectively reduced.

The suction pressure pulsation in the suction chamber of a compressor, similarly to the discharge pressure pulsation, also propagates through the gas-conduit to the evaporator and causes similar noise problems.

It is known that the resonant frequency of the evaporator of an automotive climate control system is in the range of 500 to 1000 Hz. Accordingly, a muffler has been arranged for reducing the suction pressure pulsation of a frequency in the range of 500 to 1000 Hz in the conduit connecting the evaporator to the suction chamber of a compressor.

Nevertheless, the muffler requires an additional space in the vehicle and unavoidably increases the cost of the automotive climate control system.

DISCLOSURE OF THE INVENTION

In view of the foregoing problems with conventional compressors, an object of the present invention is to reduce the pressure pulsations in a refrigerant during the suction, the compression, and the discharge of the refrigerant gas in a reciprocating type compressor for a climate control system.

Another object of the present invention is, in a climate control system, to reduce or to stop propagation of a direct component of the pressure pulsations from the cylinder bores of a reciprocating type compressor directly to the gas-conduit of a climate control system, and to reduce or stop propagation of the indirect component of the pressure pulsation caused by the shape of the discharge chamber of the reciprocating type compressor.

In one embodiment of the present invention, in a reciprocating compressor including a cylinder block having a plurality of cylinder bores formed therein so as to have axes parallel to the axis of the cylinder block, and a cylinder head attached to one end of the cylinder block via a valve plate so as to close the cylinder block end and to form a discharge chamber therein, an auxiliary discharge chamber is additionally formed in the cylinder block at a position radially inside the arrangement of the plurality of cylinder bores, end the auxiliary discharge chamber is communicated with the discharge chamber by means of at least one through-hole formed in the above-mentioned valve plate.

In another embodiment of the present invention, the auxiliary discharge chamber is communicated with the discharge Chamber by means of at least one inlet through-hole formed in the valve plate, and the auxiliary discharge chamber is also communicated with an outlet passage by means of an outlet port formed in the valve plate.

The constructions in the first and the second embodiments of the present invention are applicable to a reciprocating type compressor in which an arrangement of discharge and suction chambers is changed in such a manner that the suction chamber is arranged in the central portion of the cylinder block, and the discharge chamber is arranged in the peripheral portion of the cylinder block.

In a preferred embodiment of the present invention, an auxiliary discharge chamber or an auxiliary suction chamber is formed so as to have the shape of a sprocket whereby portions of the chamber extends into portions of the cylinder block between the adjacent cylinder bores.

In a further embodiment of the present invention, a reciprocating compressor has a cylinder head provided in its central portion with a suction chamber connected to an evaporator by a passage for sucking a refrigerant gas therein flowing out of the evaporator, a cylinder block and the valve plate, wherein an auxiliary suction chamber is formed in both the cylinder block and the valve plate so that the suction chamber and the auxiliary suction chamber are arranged axially, and the axial whole length L of the auxiliary suction chamber and the suction chamber is selected so as to be related to the resonant frequency of the evaporator.

In the reciprocating type compressor in accordance with the present invention having a cylinder head provided with a discharge chamber, in which an auxiliary discharge chamber is communicated with the discharge chamber by means of at least one through-hole formed in the valve plate, the auxiliary discharge chamber formed in the cylinder block substantially increases the volume of the discharge chamber, to thereby suppress the pulsation in the discharge pressure of the compressor.

In the above-mentioned embodiment of the present invention, when the through-hole is arranged so as to function as a gas-flow restrictor, the pressure wave of the gaseous refrigerant in the discharge chamber and that of the same in the auxiliary discharge chamber, differing in phase from each other, interfere with each other to reduce the peak values of the pressure waves, so that the pulsation of the discharge pressure can be further suppressed and smoothed.

In a further embodiment of the present invention, since the discharge chamber and the auxiliary discharge chamber are communicated with each other by means of the inlet through-hole, and the outlet port of the auxiliary discharge chamber is connected to the outlet passage fluidly connected to the climate control system, all the gaseous refrigerant is discharged from the discharge chamber into the auxiliary discharge chamber, and then flows from the auxiliary discharge chamber into the outlet passage. Therefore, the effect of two stages of expansion of the gaseous refrigerant that occur when the gaseous refrigerant is discharged from the cylinder bores into the discharge chamber and when the gaseous refrigerant flows from the discharge chamber through the inlet through-hole into the auxiliary discharge chamber effectively reduces pressure pulsations in the refrigerant gas. Accordingly, the resonance of the equipment in the vehicle can be obviated and noise can be reduced even if respective natural vibration frequencies of the equipment in the vehicle coincide with the frequency of the indirect component of the pressure pulsation attributable to the shape of the discharge chamber. The propagation of the direct component of the pulsating discharge pressure of the refrigerant gas discharged from the cylinder bores to the gas-conduit of the climate control system can be avoided by the structural effect.

Similarly, when the reciprocating compressor having a cylinder head provided with a suction chamber formed therein has the same construction and arrangement as the above-mentioned former embodiment, the auxiliary suction chamber substantially increases the volume of the suction chamber, and the pulsation of the suction refrigerant gas can be suppressed by the interference between the flow of the gaseous refrigerant through the through-hole and the phase difference between the pressure wave of the gaseous refrigerant in the suction chamber and that of the gaseous refrigerant in the auxiliary suction chamber.

In the latter embodiment, the pulsations in the suction pressure of the refrigerant can be reduced at two stages in the suction chamber and the auxiliary suction chamber and, consequently, the indirect component attributable to the shape of the suction chamber can be reduced, and the propagation of the direct component of the pulsation of suction pressure that occurs when the refrigerant is sucked into the cylinder bores from the gas-conduit of the climate control system can be avoided by a structural improvement made by using the present invention.

The volume of the auxiliary discharge chamber or the auxiliary suction chamber can be more effectively increased by forming the auxiliary discharge chamber or the auxiliary suction chair in the shape of a sprocket.

When the axial whole length L of the auxiliary suction chamber and the suction chamber is set so as to be related to the resonant frequency of an evaporator in a climate control system, the pulsation of the suction pressure of a specific frequency that makes the evaporator resonate can be effectively damped.

In an embodiment of the present invention, an auxiliary discharge chamber or an auxiliary suction chamber formed in a portion of the cylinder block radially inside the arrangement of the plurality of bores is communicated with the discharge chamber or the suction chamber formed in the cylinder block by means of a through-hole. Therefore, the through-hole and the auxiliary discharge chamber function acts as B muffler for the discharge chamber, or the through-hole and the auxiliary suction chamber function acts as a muffler for the suction chamber, so that pressure pulsation is remarkably suppressed, whereby the vibration of the gas-conduit and noise are reduced satisfactorily.

In another embodiment of the present invention, the effect of two stages of expansion of the gaseous refrigerant that occurs when the gaseous refrigerant flows from the bore through the discharge port into the discharge chamber and when the gaseous refrigerant flows from the discharge chamber through the inlet port into the auxiliary discharge chamber reduces the pulsation of the discharge pressure, so that the resonance of the equipment in the vehicle with the indirect component of the discharge pressure pulsation can be prevented and so that the propagation of the direct component of the discharge pressure pulsation can be intercepted, In principle, the resonance of the equipment in the vehicle to the indirect component of the suction pressure pulsation can be similarly prevented and the propagation of the direct component of the suction pressure pulsation can be intercepted.

BRIEF DESCRIPTION OF THE DRAWINGS

The above and other objects, features and advantages of the present invention will be made more apparent from the ensuing description of embodiments thereof, with reference to the accompanying drawings wherein.

BEST MODE OF CARRYING OUT THE INVENTION

Figure 1:
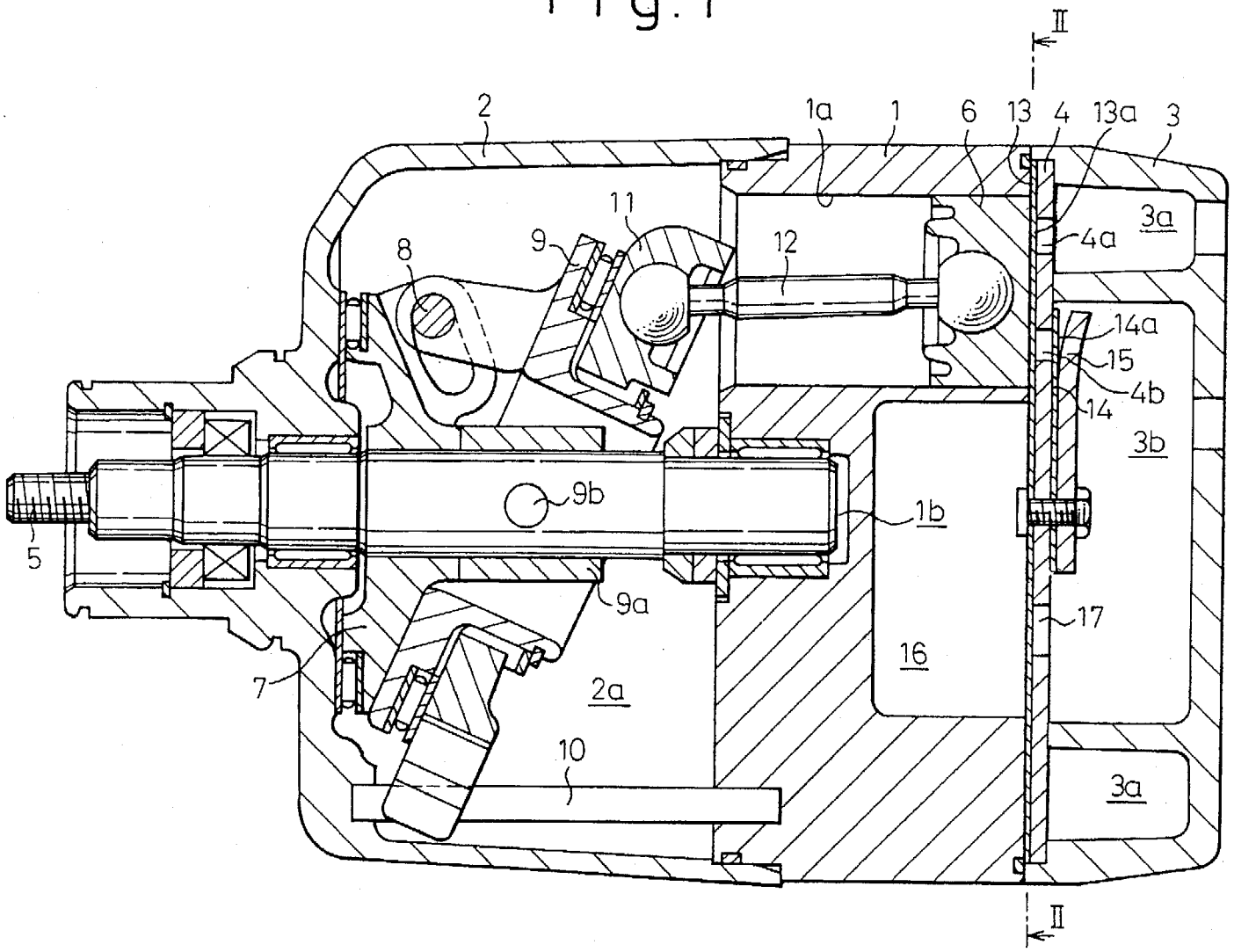
FIG. 1 is a sectional view of a compressor according to a first embodiment of the present invention.
Figure 2:
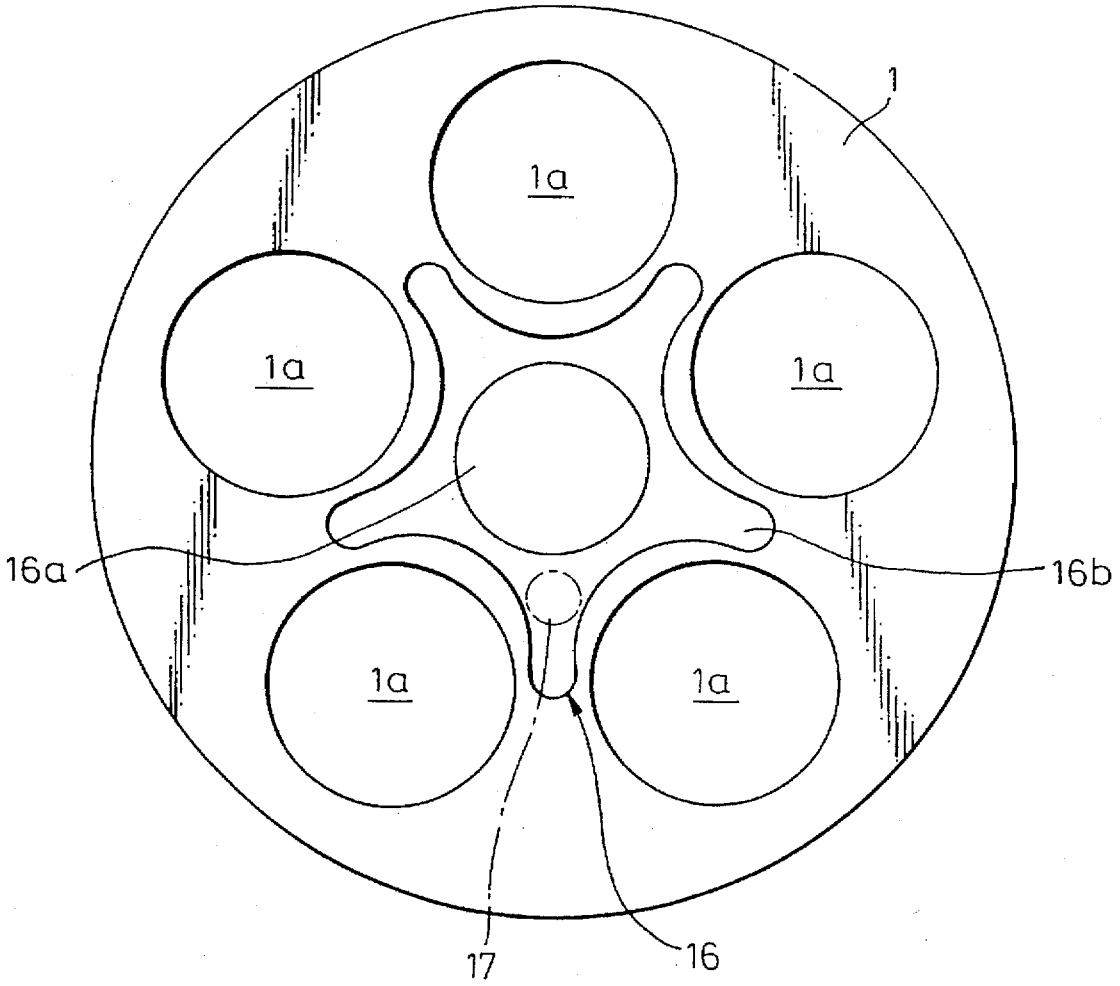
FIG. 2 is an end view of a cylinder block of the compressor of FIG. 1, taken along the lane II—II in FIG. 1.

FIGS. 1 and 2 illustrate a swash plate type reciprocating compressor in a first embodiment according to the present invention.

It should be noted that the present invention is not limited in its application to swash plate type reciprocating compressors, and it is generally applicable to all kinds of reciprocating piston type compressors.

Referring to FIG. 1, the compressor includes a cylinder block 1 forming an outer framework of the compressor end having a front end thereof to which a housing 2 having a crank chamber 2*a* is gas-tightly joined, A cylinder head 3 having a discharge chamber 3*b* in its central portion and a suction chamber 3*a* in its peripheral portion is gas-tightly joined to a rear end of the cylinder block 1, and a valve plate 4 is arranged between the rear end of the cylinder block 1 and the cylinder head 3.

A drive shaft 5 having one end supported in a central bearing hole 1*b* formed in the cylinder block 1 and the other end supported in the housing 2. The cylinder block 1 is provided with five cylinder bores 1*a* having axes parallel to the axis of the central hole 1*b*, and a piston 6 is fitted for sliding reciprocation in each cylinder bore In the crank chamber 2*a*, 6 rotating element 7 is fixedly mounted on the drive shaft 5, and a swash plate 9 swingably connected to the rotating element 7 with a pin 8 is supported by a pair of trunnions 9*b* (only one of which is shown) on a sleeve 9*a* loosely mounted on the drive shaft 5.

A wobble-plate 11 is mounted on the swash plate 9 and is restrained from rotation by a long bolt 10 extending through the wobble-plate 11. Each piston 6 is connected to the wobble-plate 11 by a connecting rod 12.

The valve plate 4 is provided with suction ports 4*a* and discharge ports 4*b* for fluidly connecting the cylinder bores 1*a* to the suction chamber 3*a* and the discharge chamber 3*b*, respectively. A suction valve element 13 is held on the front surface of the valve plate 4, and a discharge valve element 14 is retained on the rear surface of the valve plate 4 with a retainer 15. Reed valves 13*a* formed in the suction valve element 13 open and close the corresponding suction ports 4*a* in synchronism with the reciprocation of the corresponding pistons 6.

Similarly, reed valves 14*a* formed in the discharge valve element 14 open and close the corresponding discharge ports 4*b* in synchronism with the reciprocation of the corresponding pistons 6.

The construction of this reciprocating compressor is similar to that of the conventional swash plate type reciprocating compressor. The rotation of the drive shaft 5 is converted by the swash plate 9 into a nutating motion of the wobble-plate 11 to reciprocate the pistons 6 in the cylinder bores 1*a* and, consequently, a refrigerant gas is sucked from the suction chamber 3*a* into the cylinder bores 1*a*, and the compressed refrigerant gas is discharged toward the discharge chamber 3*b*. The reciprocating stroke of the respective pistons 6 and the inclination angle of the wobble-plate 11 are controlled in response to a difference between crank chamber pressure end discharge chamber pressure to thereby control the discharge rate of the compressed refrigerant gas.

In the compressor of the present embodiment, a central portion of the cylinder block I surrounded by the arrangement of the bores 1*a* is bored to form an auxiliary discharge chamber 16. As shown in FIG. 2, the auxiliary discharge chamber 16 is formed in the shape of a sprocket wheel in the central solid portion of the cylinder block i in front of the central bearing hole 1*b* having a bottom near the rear end of the drive shaft 5, and portions of the auxiliary discharge chamber 16 are extended from the central portion 16*a* of the cylinder block I into portions 16*b* of the cylinder block I between the adjacent bores 1*a* in order that the auxiliary discharge chamber 16 has the largest possible volume. The auxiliary discharge chamber 16 is communicated with the discharge chamber 3*b* through a through-hole 17 penetrating the valve plate 4 and the suction valve element 13. In the present embodiment, the through-hole 17 is a single round hole formed at an optional radial position. Although there is no particular restriction on the sectional area of the through-hole 17, the sectional area is small enough, as compared with the sectional area of the auxiliary discharge chamber 16, so as to allow the through-hole function as a restrictor. However, a plurality of through-holes may be distributed on the valve plate 4 and the suction valve element 13.

The discharge pressure in the discharge chamber 3*b* of the compressor pulsates as the pistons 6 reciprocate. As the pressure in the discharge chamber 3*b* pulsates, the pressure of the refrigerant gas in the discharge chamber 3*b* and that of the refrigerant gas in the auxiliary discharge chamber 16 interfere with each other through the through-hole 17, i.e., the restrictor; that is, when the pressure in the discharge chamber 3*b* is higher than that in the auxiliary discharge chamber 16, the refrigerant gas flows through the through-hole 17 into the auxiliary discharge chamber 16. Consequently, the maximum value (peak value) of the waveform of the pressure in the discharge chamber 3*b* is controlled eta comparatively low value.

Figure 3:
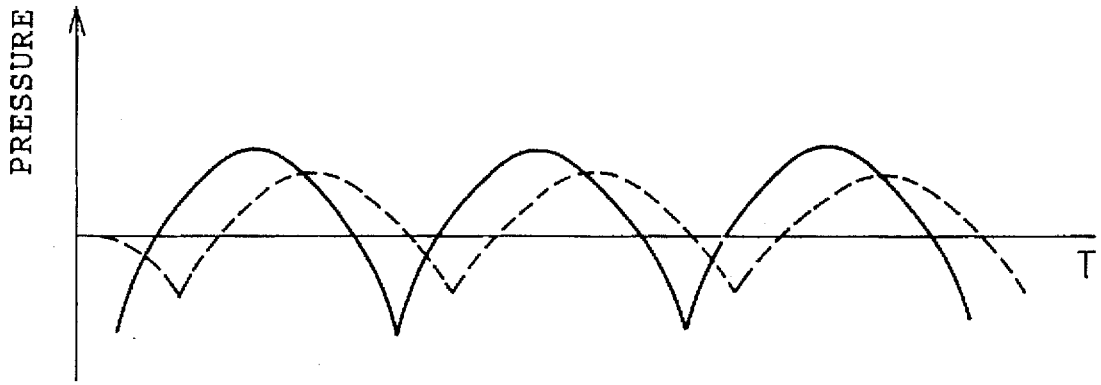
FIG. 3 is a diagram illustrating waveforms of pulsating pressures occurring in a discharge chamber and an auxiliary discharge chamber when the pulsation of discharge pressure is smoothed by the present invention.

When the pressure within the auxiliary discharge chamber 16 is increased by the refrigerant gas that flows from the discharge chamber 3*b* into the auxiliary discharge chamber 16 to a pressure higher than the pressure in the discharge chamber 3*b* which is decreasing toward the minimum value, the refrigerant gas flows from the auxiliary discharge chamber 16 into the discharge chamber 3*b*. Thus, the minimum value of the waveform of the pressure in the discharge chamber 3*b* is raised. FIG. 3 illustrates the waveforms of the pressures in the discharge chamber 3b and the auxiliary discharge chamber interfering with each other. In FIG. 3, the continuous line indicates the waveform of the pressure in the discharge chamber 3b and the broken line indicates the waveform of the pressure in the auxiliary discharge chamber 16.

Since the discharge chamber 3b and the auxiliary discharge chamber 16 communicate with each other by means of the through hole 17, the waveform of the pressure in the auxiliary discharge chamber 16 lags by a phase difference behind the waveform of the pressure in the discharge chamber 3b, so that the pressures in the auxiliary discharge chamber 16 interferes with that in the discharge chamber 3b. The interference between the pressures having a phase difference reduces the respective maximum values of the pressures and increases the respective minimum values of the same to smooth the waveform of the pulsating discharge pressure. Thus the waveform of the pulsating discharge pressure in the discharge chamber 3b causing the condenser and the associated devices to vibrate is smoothed and, consequently, noise that prevails in the passenger compartment of the vehicle when the climate control system is in operation, and interferes with the auditory function of the passengers, can be reduced.

Generally, the dependence of the pulsation of the discharge pressure on the displacement of each bore and the volume of the discharge chamber is expressed by:

(Pulsation of discharge pressure)=(Displacement of bore)/(Volume of discharge chamber)

Therefore, the amplitude of the pressure in the auxiliary discharge chamber 16, indicated by a broken line, is further reduced by forming the auxiliary discharge chamber 16 in the shape of a sprocket wheel so that the auxiliary discharge chamber 16 has a largest possible volume, and consequently, the waveform of the pulsating discharge pressure can be further suppressed and smoothed.

When a plurality of through-holes 17 are arranged, instead of the above-mentioned single through-hole 17, some of the through-holes 17 may be covered by reed valves formed in the suction valve element 13.

When the plurality of through-holes 17 are arranged, and reed valves are provided for covering some of the through-holes 17, the reed valves open wide when the pressure in the discharge chamber increases to thereby substantially increase the volume of the discharge chamber 3b by a substantial expansion of the discharge chamber 3b. The effect of the substantial expansion of the discharge chamber 3b accordingly lowers the maximum value of the pulsating discharge pressure.

When the pressure in the discharge chamber decreases, the refrigerant gas flows from the auxiliary discharge chamber 16 into the discharge chamber 3b at a low flow rate, and hence the minimum value of the waveform of the pressure in the auxiliary discharge chamber 16 is higher than that of the auxiliary discharge chamber 16 shown in FIG. 3. Consequently, the pressures in the auxiliary discharge chamber 16 and in the discharge chamber 3b interact so that the minimum value of the pulsating discharge pressure is further raised.

Figure 4:
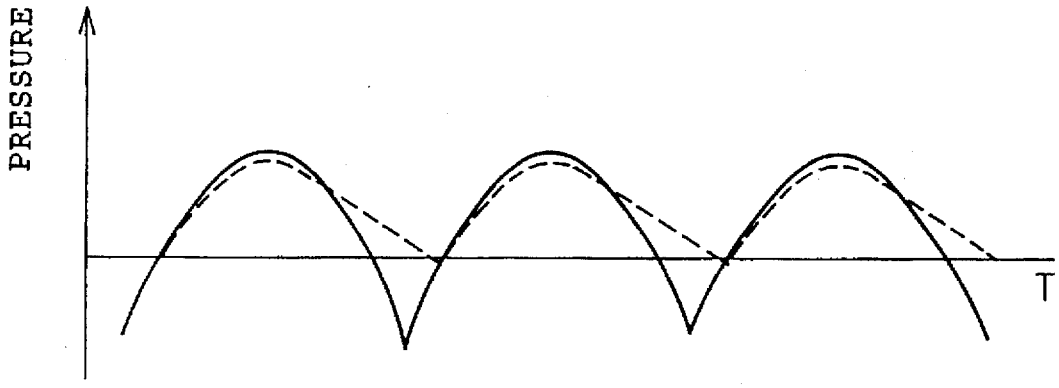
FIG. 4 is a diagram illustrating waveforms of pulsating pressures occurring in the discharge chamber and the auxiliary discharge chamber when reed values are placed over the through-holes in accordance with the present invention.

FIG. 4 illustrates the waveforms of the pressures in the discharge chamber 3b and the auxiliary discharge chamber 16 in the above-described case.

SECOND EMBODIMENT

The present invention is applicable not only to suppression of the discharge pressure pulsation but also to suppression of the suction pressure pulsation.

A compressor according to the second embodiment of the present invention, in which the suction pressure pulsation is suppressed and smoothed, will be described below.

Figure 5:
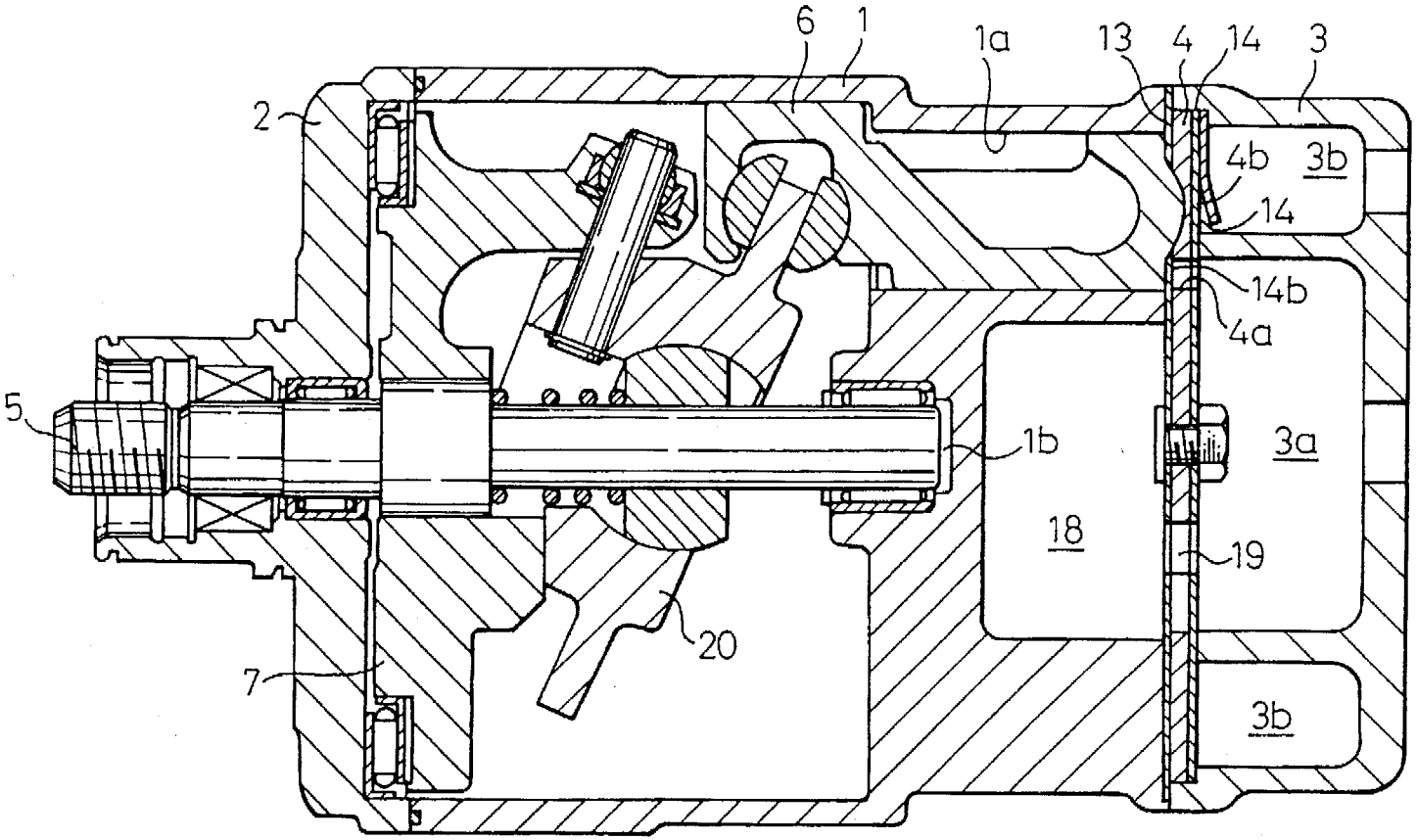
FIG. 5 is a sectional view of a compressor according to a second embodiment of the present invention, illustrating a general construction thereof.

FIG. 5 illustrates a compressor constructed in accordance with the present invention in order to reduce the suction pressure pulsation, and elements end parts like or identical to those of the compressor of FIG. 1 are designated by the same reference numerals.

The compressor is provided with a swash plate 20 which drives the reciprocation of pistons 6. A suction chamber 3a is formed in the central portion of lo a cylinder head 3, and discharge chamber 3b is formed in the peripheral portion of the cylinder head 3 so as to surround the suction chamber 3a. An auxiliary suction chamber 18 having a shape similar to that of the auxiliary discharge chamber 16 shown in FIG. 2, resembling the shape of a sprocket wheel is formed in the central portion arranged adjacent to a closed central Bearing hole 1b, and in portions of the cylinder Block I disposed between adjacent cylinder bores 1a.

The auxiliary suction chamber 18 is communicated with a suction chamber 3a via a through-hole 19 bored in a valve plate 4 and a suction valve element 13, in a manner similar to the case of the afore-described auxiliary discharge chamber 16 of the compressor shown in FIG. 1.

In the compressor, the suction pressure pulsation in the suction chamber 3a can be smoothed by pressure interference in a manner similar to that of smoothing the discharge pressure pulsation in the discharge chamber of the previous embodiment shown in FIG. 1.

Although the auxiliary discharge chamber 16 of the first embodiment or the auxiliary suction chamber 18 of the second embodiment is formed in portions of the cylinder block I including the central portion thereof in which the above-mentioned closed central bearing hole 1b is formed, the auxiliary discharge chamber 16 or the auxiliary suction chamber 18 may be formed around the central bearing hole 1b when the hole 1b is formed axially deep in the central portion of the cylinder block I so that the bottom of the central bearing hole 1b is arranged close to the valve plate 4 held on the cylinder block 1. Such construction of the auxiliary suction or discharge chamber can also suppress end smooth the suction or discharge pressure pulsation.

When the central bearing hole 1b is formed axially deep in the cylinder block I with its bottom arranged close to the end surface of the cylinder block 1, and the auxiliary discharge chamber 16 or the auxiliary suction chamber 18 is formed around the central bearing hole 1b, cavities appearing in respective bottom portions of the sprocket-wheel-shape auxiliary discharge or suction chamber 16 or 18 are permitted to function as gas restrictors so that the pressures of the refrigerant gas in .different cavities appearing in respective projecting portions of the auxiliary discharge or suction chamber 16 or 18 formed between the cylinder bores interfere with each other to thereby further suppress or smooth the suction or discharge pressure pulsation.

THIRD EMBODIMENT

A compressor according to a third embodiment of the present invention will be described hereinafter with reference to FIG. 6.

Figure 6:
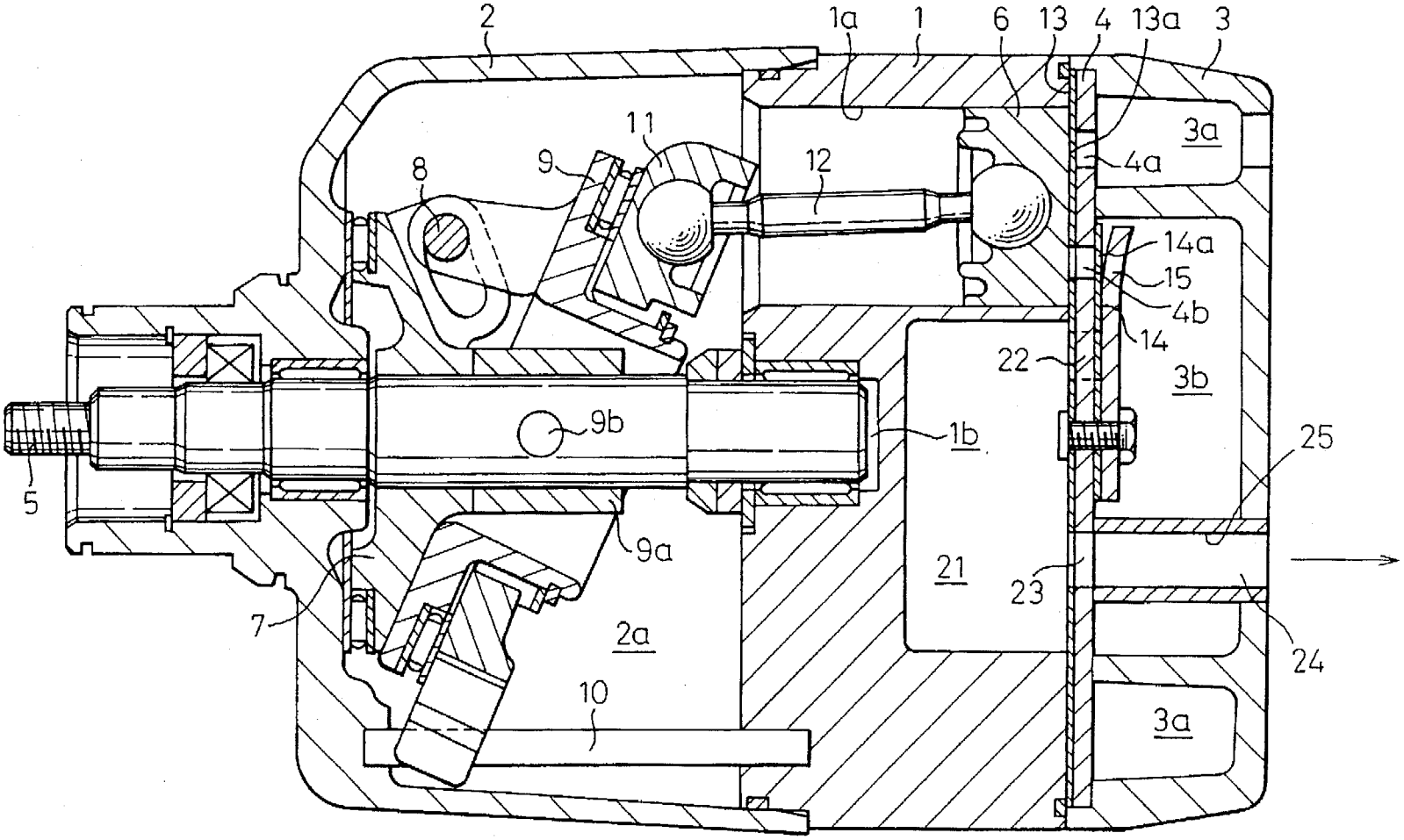
FIG. 6 is a longitudinal cross-sectional view of a compressor according to a third embodiment of the present invention, illustrating a general construction thereof.

The embodiment shown in FIG. 6, similarly to the compressor shown in FIG. 1, has a cylinder block 1, a cylinder head 3 provided with a discharge chamber 3b in its central portion and a suction chamber 3a in its peripheral portion and joined to the rear end of the cylinder block 1, and a valve plate 4 held between the cylinder head 3 and the rear end of the cylinder block 1. A central portion of the cylinder block 1 surrounded by a plurality of cylinder bores 1*a* is bored so as to define en axial discharge chamber 21 in the shape of a sprocket wheel.

The third embodiment features an inlet through-hole 22 penetrating the valve plate 4 and a suction valve element 13 so as to interconnect the auxiliary discharge chamber 21 and the discharge chamber 3*b*, and an outlet port 23 connected to the auxiliary discharge chamber 21 and directly opening into an outlet passage 24 of the compressor.

More specifically, the inlet through-hole similarly to the through-hole 17 of the embodiment shown in FIG. 1, is a round hole penetrating the valve plate 4 and the suction valve element 13 at an optional radial position and having a sectional area far smaller than those of the discharge chamber 3*b* and the auxiliary discharge chamber The outlet port 23 is formed so as to penetrate the valve plate 4 end the suction valve element 13, for example, on a circle on which the inlet through-hole 22 is formed, and so as to open into an outlet passage 24 defined by a pipe extended in the discharge chamber 3*b* and terminating at a discharge port 25 provided in the end wall of the cylinder head 3. The outlet passage 24 may be provided by forming a portion of the wall of the cylinder head 3 in a tubular projection extending toward the valve plate 4 during the fabrication of the cylinder head 3.

In this compressor, all the refrigerant gas discharged from the bore 1*a* through the discharge port 4*b* into the discharge chamber 3*b* expands, and it again expands when the gas flows from the discharge chamber 3*b* through the inlet through-hole 22 into the auxiliary discharge chamber 21. The principle of this refrigerant discharging method is similar to the principle of an expansion muffler for an automobile, and is capable of reducing the maximum value of the waveform of the discharge pressure twice. Accordingly, the present embodiment, similarly to the embodiment shown in FIG. 1, is capable of suppressing the discharge pressure pulsation which causes the gas-conduit line to vibrate and of reducing the noise that prevails in the passenger compartment of a vehicle.

Particularly, since this embodiment reduces the indirect component of the pulsation of a frequency in a specific frequency band caused by the shape of the discharge chamber 3*b*, generation of noise by the resonance of the equipments can be prevented even if the natural vibration frequency of any of the equipment in the vehicle coincides with the frequency of the indirect component of the pulsation.

Since each cylinder bore 1*a* and the discharge port 4*b* are separated from the discharge passage 24 by the auxiliary discharge chamber 16, the direct component of the discharge pressure pulsation is unable to propagate to the gas-conduit line.

Thus, the effect of the third embodiment shown in FIG. 6 in reducing vibrations and noise is greater than that of the first embodiment shown in FIG. 1.

The embodiment shown in FIG. 6 is applicable to the compressor shown in FIG. 5; homely, a compressor in which the arrangement, of the discharge and suction chambers is changed so that the suction chamber is formed in the central portion of the cylinder block and the discharge chamber is formed in the peripheral portion of the cylinder block.

When the present invention is applied to such a compressor, the suction chamber and the auxiliary suction chamber are interconnected by an outlet port bored in the valve plate 4 and the suction valve element 13, and an inlet through-hole is bored similarly so as to open into a suction passage. In this compressor, the direct component of the suction pressure pulsation, similarly to that of the discharge pressure pulsation, can be intercepted and the indirect component of the suction pressure pulsation can be reduced.

In the compressor in which the arrangement of the discharge and suction chambers is changed, a plurality of bores functioning as a plurality of outlet ports between the suction and auxiliary suction chambers may be formed instead of the single outlet port as is the case of the afore-mentioned through-hole 17.

FOURTH EMBODIMENT

Figure 7:
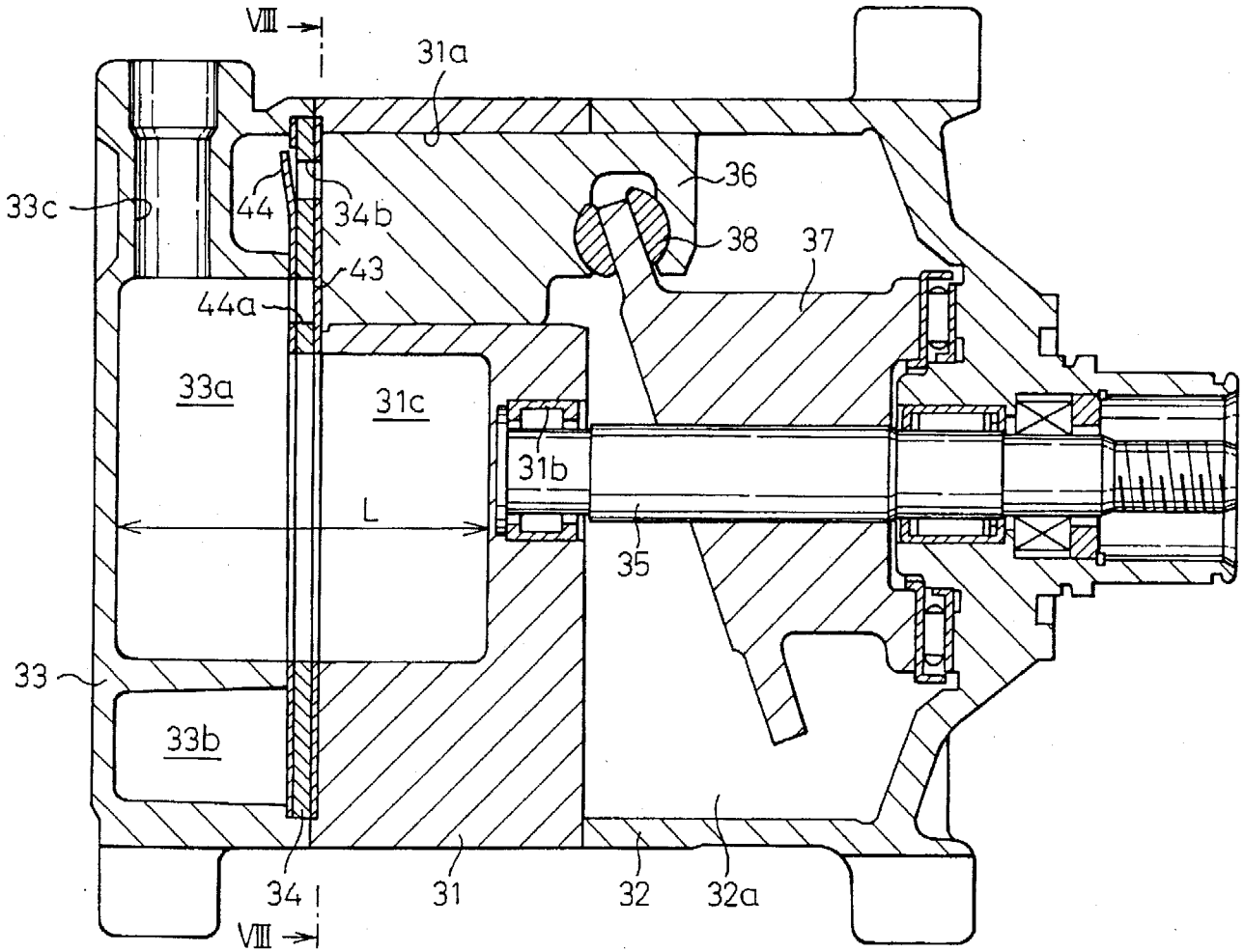
FIG. 7 is a longitudinal cross-sectional view of a compressor according to a fourth embodiment of the present invention, illustrating a construction thereof.
Figure 8:
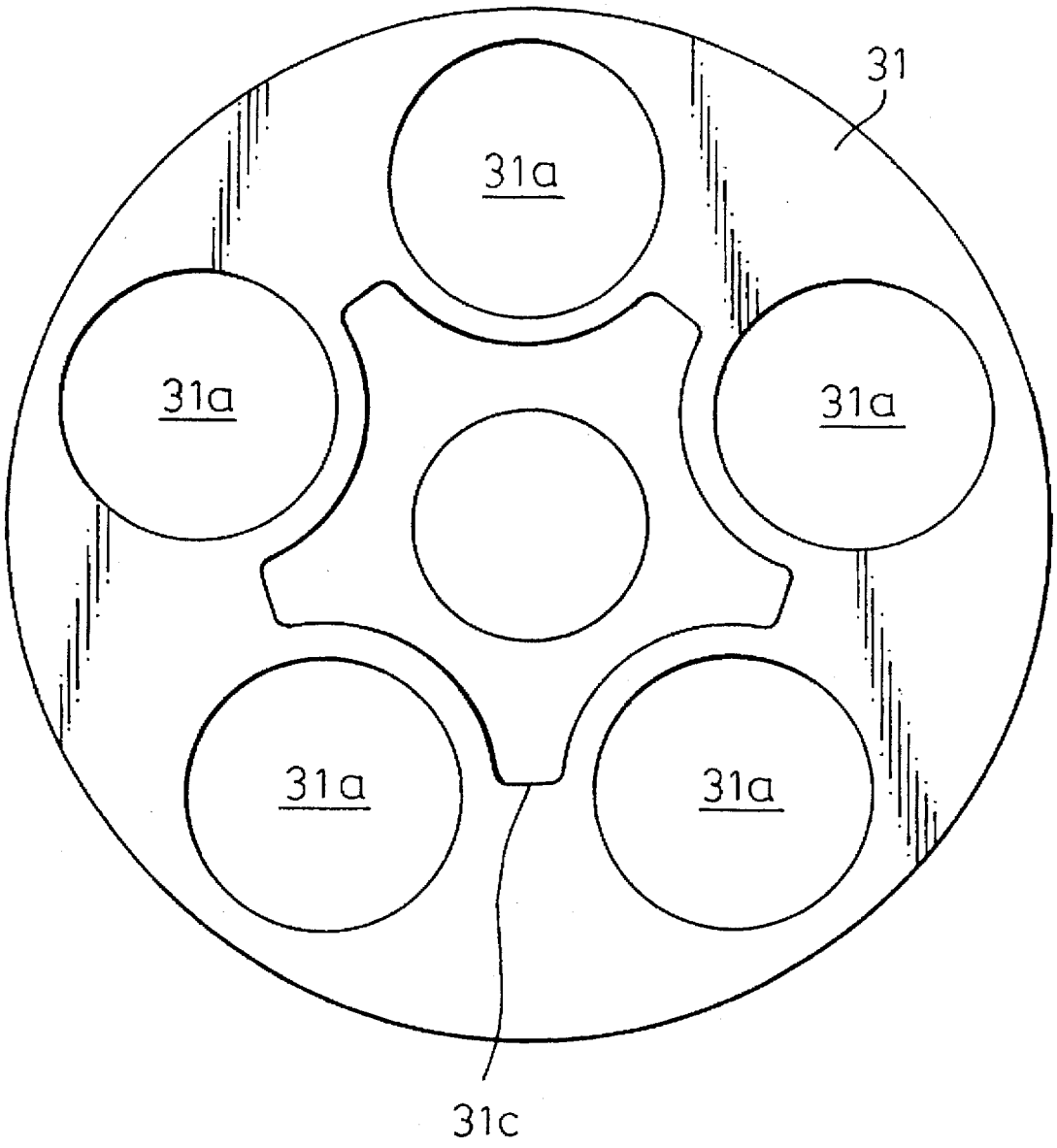
FIG. 8 is an end view of a cylinder block accommodated in the compressor of FIG. 7, taken on the line VIII—VIII in FIG. 7.

FIGS. 7 and 8 illustrate a compressor according to a fourth embodiment of the present invention.

Referring to FIG. 7, a housing 32 having a crank chamber 32*a* defined therein is joined to a front end of a cylinder block 31, a cylinder head 33 provided, in the central portion thereof, with a suction chamber 33*a* having a circular cross section, and with a discharge chamber 33*b* formed in the peripheral portion thereof so as to surround the suction chamber 33*a* is tightly joined to a rear end of the cylinder block 31, and a valve plate 34 is held between the rear end of the cylinder block 31 and the cylinder head 33.

A radial suction passage 33*c* connected to a refrigerant gas suction conduit, not shown, for connecting the compressor to an evaporator is formed in the side wall of the cylinder head 33 so as to open into the suction chamber 33*a*.

A drive shaft 35 has one end supported on the housing 32 and the other end supported in an axial, central bearing hole 31*b*. As shown in FIG. 8, five cylinder bores 31*a* are formed in the cylinder block 31 with their axes in parallel to the axis of the central bearing hole 31*b*, and pistons 36 are slidably fitted for axial reciprocation in the respective cylinder bores 31*a*.

A swash plate 37 is fixedly mounted on the drive shaft 35 within the crank chamber 32*a*, and each piston 36 is engaged with the swash plate 37 via a pair of shoes 38.

The valve plate 34 is provided with suction ports 44*a* and discharge ports 34*b* for fluidly connecting the cylinder bores 31*a* to the suction chamber 33*a* and the discharge chamber 33*b*, respectively. A suction valve element 43 is mounted on the front surface of the valve plate 34, and a discharge valve element 44 is mounted on the rear surface of the valve plate 34. The suction valves of the suction valve element 43 open and close the suction ports 44*a* in synchronism with the reciprocation of the respective pistons Similarly, the discharge valves of the discharge valve element 44 open and close the discharge ports 44*a* in synchronism with the reciprocation of the respective pistons 36.

The construction of the above-mentioned compressor is similar to that of the conventional swash plate type compressor. The rotating motion of the drive shaft 35 and the swash plate 37 is converted through the shoes 38 into the linear sliding motions of the pistons 36. Thus, the respective pistons 36 are reciprocated in the bores 31*a* so as to suck a refrigerant gas from the suction chamber 33*a* into the cylinder bores 31*a* and to discharge the compressed refrigerant gas toward the discharge chamber 33*b*.

An auxiliary suction chamber 31*c* having a uniform cross section is formed in the cylinder block 31 so as to be coaxial with a central bore formed in the valve plate 34 of the compressor in this embodiment. As shown in FIG. 8, the auxiliary suction chamber 31*c* is formed in the shape of a sprocket wheel in the central solid portion of the cylinder block 31 and is arranged adjacent to the central bearing hole 31*b* having a bottom near the rear end of the drive shaft 35, and portions of the auxiliary suction chamber 31*c* are extended into portions of the cylinder block 31 between the neighboring bores 31*a* in order that the sectional area of the auxiliary suction chamber 31*c* is as close as possible to that of the suction chamber 33*a*. The suction chamber 33*a* and the auxiliary suction chamber 31*c* are arranged coaxially one behind the other. Preferably, an axial length "L" of the suction chamber 33*a* and the auxiliary suction chamber 31*c* is 50 mm, the reason for which will be described below.

The axial length "L" is determined as set forth below.

Figure 12:
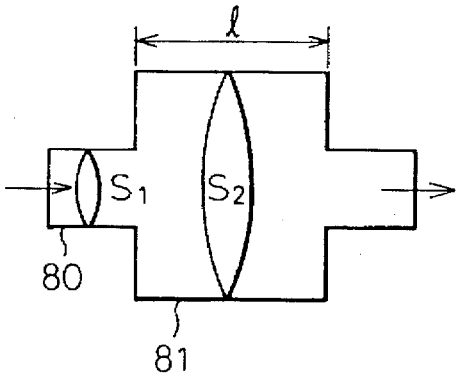
FIG. 12 is a schematic view illustrating a typical hollow muffler.
Figure 13:
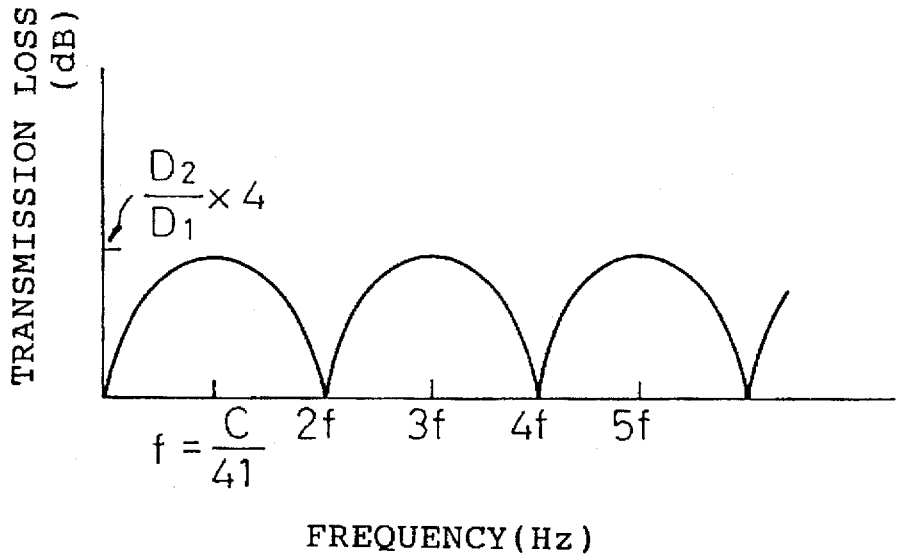
FIG. 13 is a graphical view illustrating a relationship between transmission loss and frequency with regard to the hollow muffler of FIG. 12.

Suppose that a pulsating component is applied to a common cavity muffler as Shown in FIG. 12. Then, the pulsating component is reflected and reduced by a portion of the muffler between a passage 80 having a sectional area "$S_1$" and a cavity 81 having a sectional area "$S_2$". The transmission loss (dB) in the muffler varies with frequency f (Hz) in a mode as shown in FIG. 13. The transmission loss reaches a maximum at frequencies f, 3f, 5f, . . . The frequency "f" is expressed by:

$$f=C/(4\times 1) \quad (1)$$

where c (m/s) is the flow velocity of the refrigerant and 1 (m) is the length of the cavity 81. Therefore, the frequency at which the transmission loss in the muffler reaches a maximum depends on the length "1" of the cavity 81. A maximum transmission loss "M" is expressed by:

$$M=(D_2/D_1)\times 4$$

where $D_1$ is the diameter of the passage 80 and $D_2$ is the diameter of the cavity 81.

Suppose that the passage 80 corresponds to the suction passage of the compressor in accordance with the present invention and the cavity 81 corresponds to the suction chamber and the auxiliary suction chamber of the compressor in accordance with the present invention. Then, the length L may be determined so that the frequency at which the transmission loss in the muffler reaches a maximum coincides with the resonant frequency of pulsation in the evaporator in the range of 500 to 1,000 Hz.

The compressor in the embodiment thus constructed sucks the refrigerant gas delivered from the evaporator through the suction passage 33*c* into the suction chamber 33*a*. When the refrigerant gas is thus sucked into the suction chamber 33*a*, the component of the pulsating suction pressure is reflected and reduced by the change of sectional area at the junction of the suction passage 33*c* and the suction chamber 33*a*.

In the embodiment, the auxiliary suction chamber 33*c* and the suction chamber 33*a* are formed axially continuously and the axial length L of the suction chamber 33*a* and the auxiliary suction chamber 31*c* is 50 mm. On an assumption that the flow velocity of the refrigerant gas in the suction passage 33*c* is 150 m/s, from expression (1), $$f=150[m/s]/(4\times 50\times 10^{-3}[m]=750\ (Hz)$$

Therefore, the muffler effect of a muffler structure consisting of the suction chamber 33*a* and the auxiliary suction chamber 31*c* makes the transmission loss reach a maximum at f=750 Hz when the flow velocity is 150 m/s. Thus, the compressor in the present embodiment is capable of effectively damping or suppressing the suction pressure pulsation having a frequency approximately equal to f=750 Hz, and the resonance of the evaporator having a resonant frequency of 750 Hz can be effectively suppressed.

When the flow velocity of the refrigerant in the suction passage 33*c* is 150 m/s, it is known from expression (1) that it is preferable that an appropriate value of the length L is in the range of 37.5 to 75 mm to make the transmission loss in the muffler structure consisting of the suction chamber 33*a* and the auxiliary suction chamber 31*c* to increase to a maximum at a frequency in the range of 500 to 1,000 Hz including the resonant frequency of the evaporator.

The auxiliary suction chamber 31 may have a circular cross section. It is preferable that the sectional area of the auxiliary suction chamber is as close as possible to the sectional area of the suction chamber. If the difference in sectional area between the suction chamber 33*a* and the auxiliary suction chamber 31*c* is excessively large, the frequency of the component of the pulsating pressure that can be damped is changed by another restrictive effect of the junction of the suction chamber 33*a* and the auxiliary suction chamber 31*c*, whereby the evaporator is caused to resonate. Therefore, the difference in sectional area between the suction chamber 33*a* and the auxiliary suction chamber 31*c* must be within a range that enables the present invention to exhibit its intrinsic effect.

FIFTH EMBODIMENT

The transmission loss in a muffler as shown in FIG. 2 is zero when the frequency is 2f, 4f, 6f, ...., and pulsations of a frequency corresponding to any of these frequencies cannot be damped.

In the reciprocating compressor in accordance with the present invention, the transmission loss in the muffler structure, which is zero when the frequency is 2f or 6f, can be increased to improve the damping characteristic by axially projecting a tubular part defining a suction passage from the bottom wall of the suction chamber.

Figure 14:
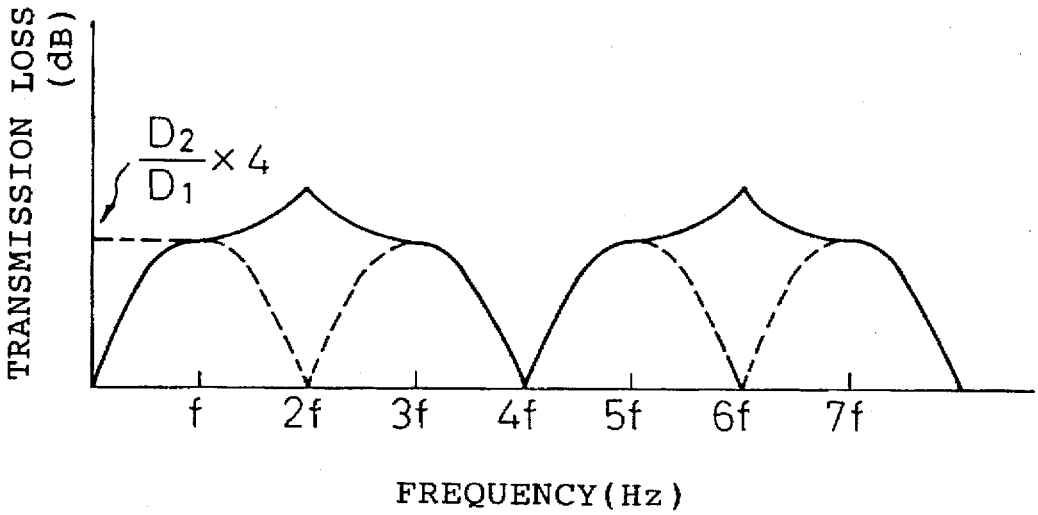
FIG. 14 is a graphical view illustrating a relationship between transmission loss in the hollow muffler of FIG. 12 and frequency when a tubular portion is provided for the hollow muffler.

When the length of the tubular part is approximately L/2, the transmission loss (dB) varies with the frequency f (Hz) in a mode indicated by continuous lines in FIG. 14. As is obvious from FIG. 14, the transmission loss in the muffler structure when the frequency is 2f or 6f can be more effectively increased and the damping characteristic can be further improved.

Figure 9:
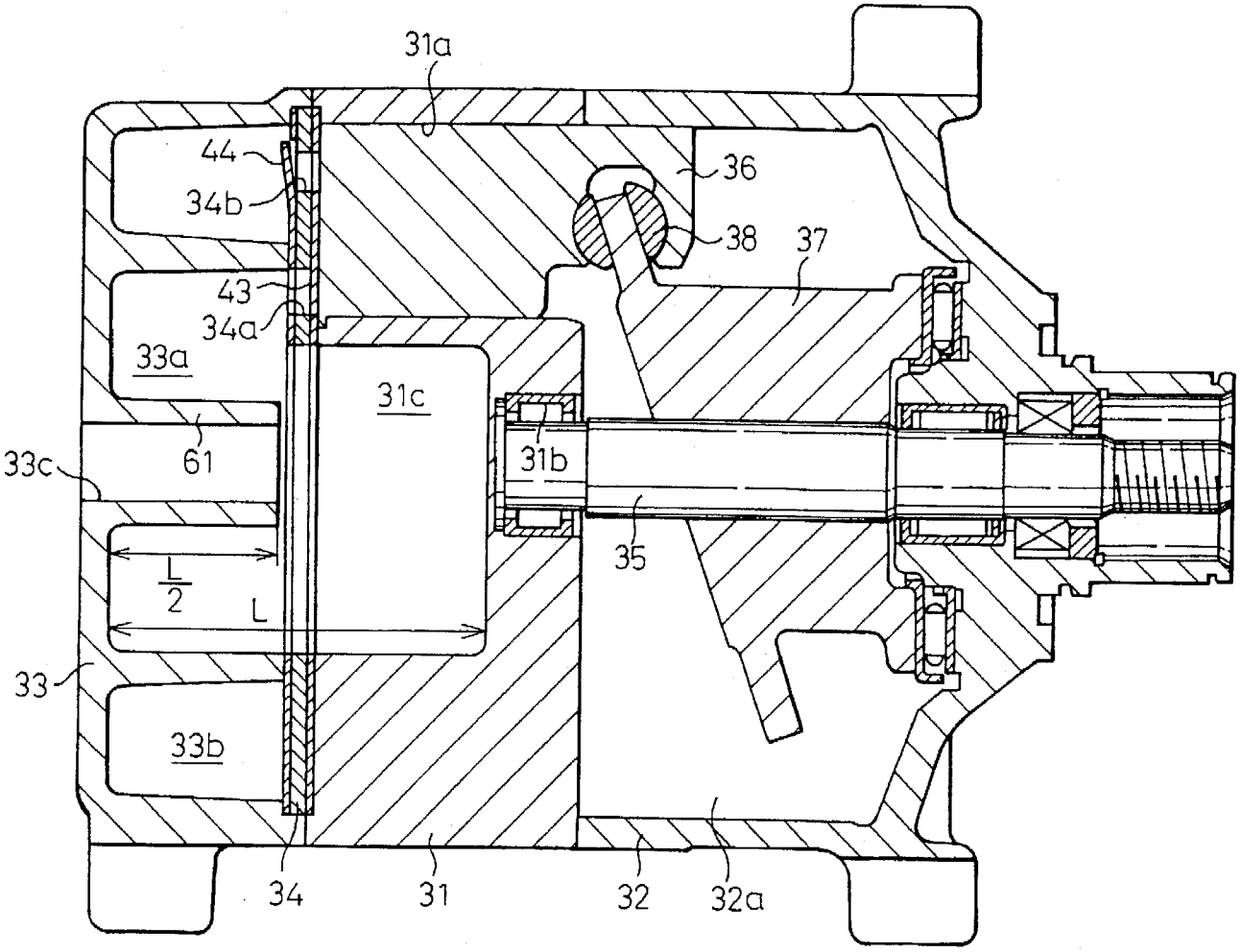
FIG. 9 is a longitudinal cross-sectional view of a compressor according to a fifth embodiment of the present invention.

In a compressor of the fifth embodiment of the present invention shown in FIG. 9, a tubular part 61 defining a suction passage 33*c* axially projects from the central portion of the bottom wall of a suction chamber 33*a*. The other construction of the compressor is similar to that of the compressor of the fourth embodiment. The length of the tubular part 61, i.e., the distance between the bottom wall of the suction chamber 33*a* to the extremity of the tubular part is L/2, in which L is the axial length of a suction chamber 33*a* and an auxiliary suction chamber 31*c*.

Since the tubular part 61 of a length L/2 makes the transmission loss of the compressor vary with frequency in a mode as shown in FIG. 14, the suction pressure pulsation of a frequency around 2f=1500 can be effectively damped as well as the pulsation of suction pressure of a frequency around f=750 Hz.

Although the tubular part 61 of a length L/2 is projected from the central portion of the bottom wall of the suction chamber 33*a* in the present embodiment, the length and the position of the tubular part 61 need not necessarily be limited thereto; for example, the tubular part 61 may be projected from the peripheral portion of the bottom wall of the suction chamber 33*a* or from the side wall of the suction chamber 33*a*.

SIXTH EMBODIMENT

Figure 10:
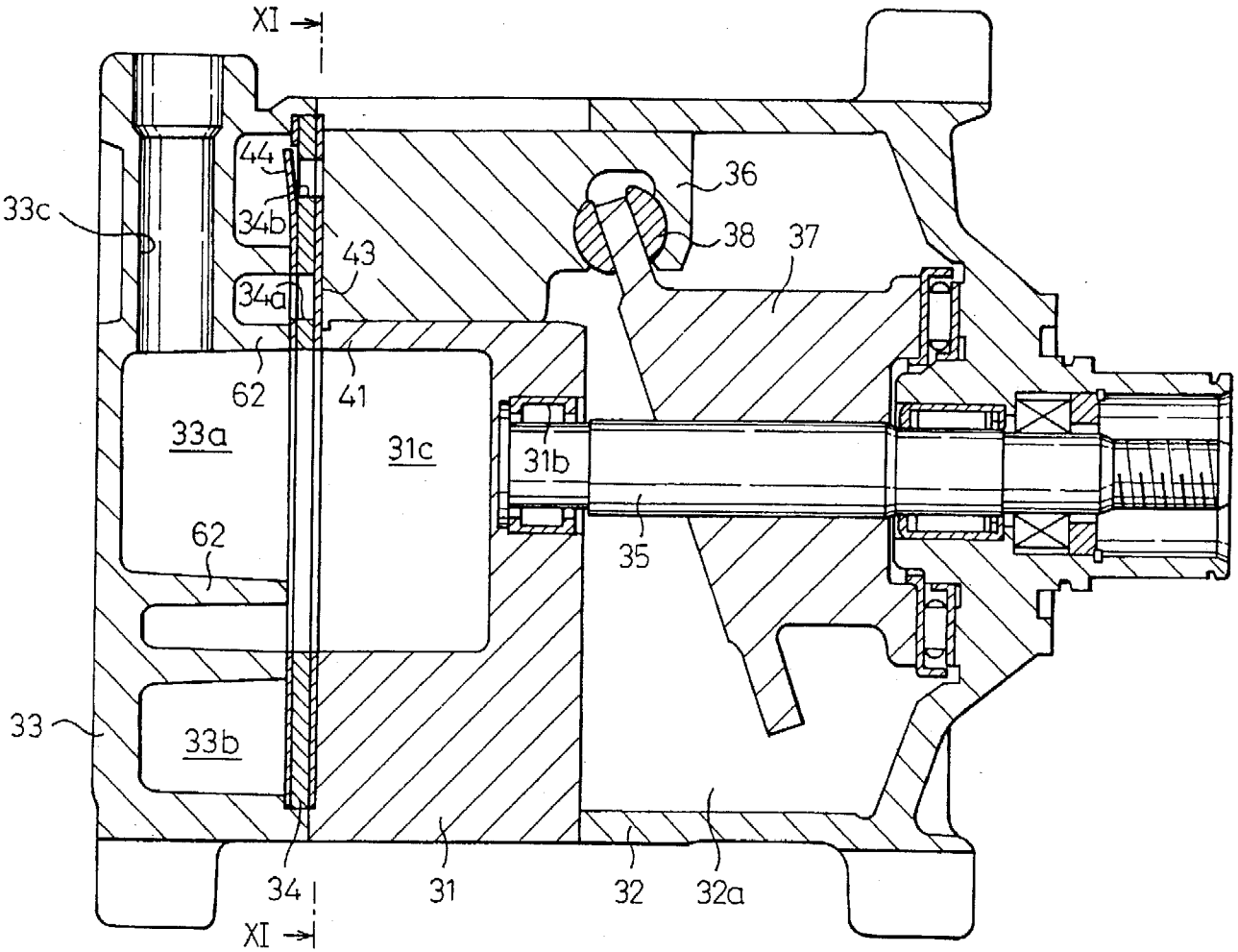
FIG. 10 is a longitudinal cross-sectional view of a compressor according to a sixth embodiment of the present invention.
Figure 11:
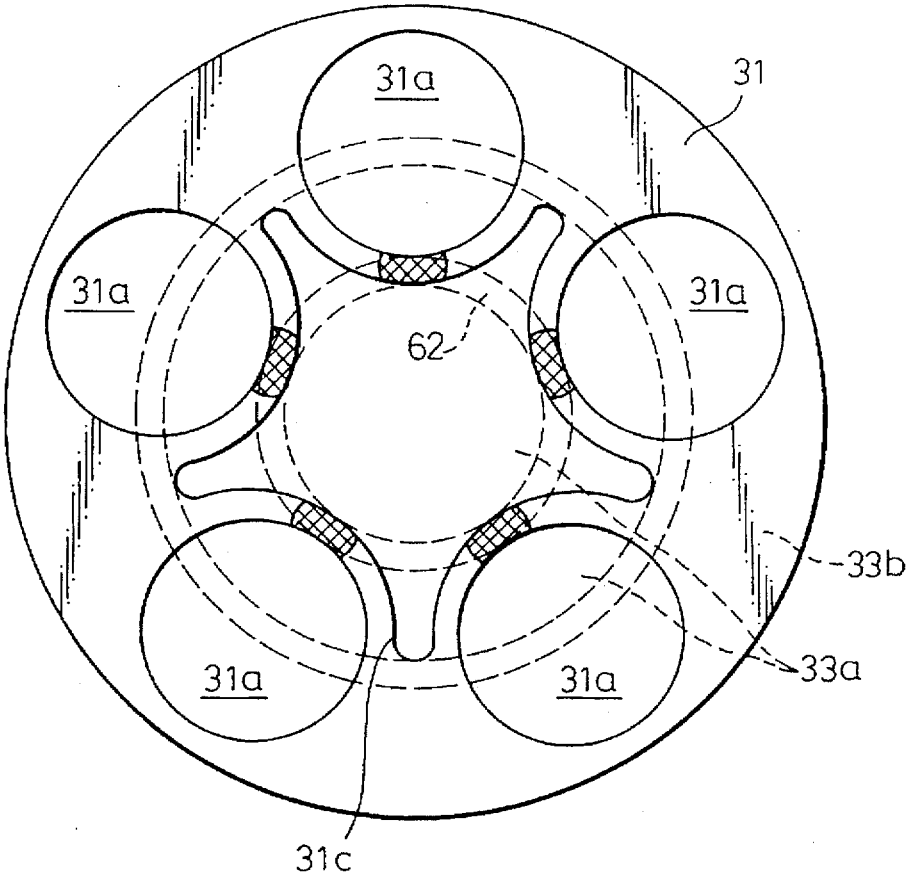
FIG. 11 is an end view of a cylinder block accommodated in the compressor of FIG. 10, taken on the line XI—XI in FIG. 10.

A compressor according to a sixth embodiment of the present invention, as shown in FIGS. 10 and 11 is provided with an annular rib 62 supporting a valve plate 34 and projecting from the bottom wall of a suction chamber 33*a* so as to confront a partition wall 41 separating each of cylinder bores 31*a* formed in a cylinder block 31 from an auxiliary suction chamber 31*c*. As shown in FIG. 11, the outer circumference of the rib 62 coincides with an imaginary circle with which the cylinder bores 31*a* are externally in contact, and the inner circumference of the rib 62 coincides with an imaginary circle of a diameter corresponding to the minimum diameter of the auxiliary suction chamber 31*c*. The rest of structural configuration of the compressor is similar to that of the compressor of the afore-mentioned fourth embodiment.

In the fourth and the fifth embodiments, in which the auxiliary suction chamber 31*c* is formed in a portion of the cylinder block 31 surrounded by the arrangement of the cylinder bores 31*a*, there is the possibility that pressure leaks from the cylinder bore 31*a* into the auxiliary suction chamber 31*c* when the valve plate 34 is lifted up from the cylinder block 31 by the internal pressure of the bore 31*a* during the compression stroke. In the compressor of the present embodiment, the valve plate 34 is supported by the rib 62 confronting the partition wall separating the cylinder bores 31*a* of the cylinder block 31 from the auxiliary suction chamber 31*c*.

Since the valve plate 34 is held between the rib 62 and the partition wall 41, pressure leakage from the cylinder bores 31*a* into the auxiliary suction chamber 31*c* can be surely prevented.

The rib 62 need not necessarily be of an annular shape; for example, a plurality of individual ribs may be formed only at positions corresponding to shaded areas shown in FIG. 11 where the annular rib 62 is in registration with the partition wall 41.

Naturally, such ribs are unnecessary when the valve plate 34 has a rigidity high enough to withstand the internal pressure of the bore during the compression stroke and there is no possibility that pressure leaks from the bores 31*a* into the auxiliary suction chamber 31*c*.

We claim:

1. A reciprocating type compressor including a cylinder block provided with a plurality of parallel cylinder bores formed with their axes in parallel to the axis of the cylinder block, reciprocating pistons fitted in the plurality of cylinder bores for sliding reciprocation therein to suck a refrigerant gas thereinto, to compress the refrigerant gas in, and to discharge the compressed refrigerant gas from said cylinder bores, a cylinder head tightly joined to one end of said cylinder block and provided with a suction chamber and a discharge chamber formed therein, and a valve plate held between said cylinder block and said cylinder head; and wherein said cylinder block is provided in a portion thereof surrounded by an arrangement of said plurality of cylinder bores with an auxiliary chamber, said auxiliary chamber comprising an auxiliary discharge chamber in fluid communication with said discharge chamber via at least one through-hole bored in said valve plate so as to provide a flow passageway of a fluid between said auxiliary chamber and said discharge chamber.

2. A reciprocating type compressor according to claim 1, wherein said valve plate is provided with at least one outlet port formed therein so as to open into said auxiliary discharge chamber, said outlet port providing a fluid connection between said auxiliary discharge chamber and an outlet passageway of said compressor.

3. A reciprocating type compressor according to claim 1, wherein said auxiliary chamber is defined as a chamber having a cross section in a plane perpendicular to said axis of said cylinder block, said cross section having the shape of a sprocket wheel, said auxiliary chamber having portions extending into portions of said cylinder block between neighboring cylinder bores of said plurality of cylinder bores.

4. The reciprocating type compressor according to claim 1, wherein said auxiliary discharge chamber formed in said portion of said cylinder block surrounded by an arrangement of said plurality of cylinder bores is arranged substantially radially inside said arrangement of said plurality of cylinder bores.

5. The reciprocating type compressor according to claim 1, wherein said compressor is provided with an axial and rotatable drive shaft on which a piston reciprocating means is supported, said drive shaft having a rear end rotatably supported by bearings arranged in a space in said cylinder block, and wherein said auxiliary discharge chamber is arranged at a rear side of and separated from space within said cylinder block.

6. The reciprocating type compressor according to claim 1, wherein said auxiliary discharge chamber is a single chamber.

7. The reciprocating type compressor according to claim 1, wherein said compressor is a single-headed reciprocating piston type compressor.

8. A reciprocating type compressor including a cylinder block provided with a plurality of parallel cylinder bores formed with their axes in parallel to the axis of the cylinder block, reciprocating pistons fitted in the plurality of cylinder bores for sliding reciprocation therein to suck a refrigerant gas thereinto, to compress the refrigerant gas in, and to discharge the compressed refrigerant gas from, said cylinder bores, a cylinder head tightly joined to one end of said cylinder block and provided with a suction chamber and a discharge chamber formed therein, and a valve plate held between said cylinder block and said cylinder head;

wherein said cylinder block is provided with an auxiliary chamber in a substantially radially internal portion thereof externally surrounded by an arrangement of said plurality of cylinder bores, and said auxiliary chamber is in communication with one of said discharge chambers and said suction chamber via at least one through-hole bored in said valve plate so as to provide a flow passageway of a fluid between said auxiliary chamber and said one of said discharge chambers and said suction chamber.

9. A reciprocating type compressor according to claim 8, wherein said auxiliary chamber comprises an auxiliary discharge chamber fluidly connected with said discharge chamber.

10. A reciprocating type compressor according to claim 9, wherein said valve plate is provided with at least one outlet port formed therein so as to open into said auxiliary discharge chamber, said outlet port providing a fluid connection between said auxiliary discharge chamber and the outlet passageway of said compressor.

11. A reciprocating type compressor according to claim 8, wherein said auxiliary chamber comprises an auxiliary suction chamber fluidly connected with said suction chamber.

12. A reciprocating type compressor according to claim 11, wherein said valve plate is provided with an inlet through-hole formed therein so as to provide a fluid connection between said auxiliary suction chamber and an inlet passageway of said compressor.

13. A reciprocating type compressor according to claim 8, wherein said auxiliary chamber is defined as a chamber having a cross section in a plane perpendicular to said axis of said cylinder block said cross section having the shape of a sprocket wheel, said auxiliary chamber having portions extending into portions of said cylinder block between neighboring cylinder bores of said plurality of cylinder bores.

14. A reciprocating type compressor according to claim 8, wherein said suction chamber is disposed for sucking a refrigerant gas from an evaporator through a suction passageway therein, and wherein said auxiliary chamber is in fluid communication with said suction chamber through said valve plate, and an axial length L of said auxiliary chamber and said suction chamber is determined in relation to the resonant frequency of said evaporator.

15. A reciprocating type compressor according to claim 8, wherein said compressor is provided with axial and rotatable drive shafts on which a piston reciprocating means is supported, said drive shafts having a rear end rotatably supported by bearings arranged in a space in said cylinder block, and wherein said auxiliary chamber is arranged at a rear side of and separated from said space within said cylinder block.

16. A reciprocating type compressor according to claim 8, wherein said auxiliary chamber is a single chamber.

17. A reciprocating type compressor according to claim 8, wherein said compressor is a single-headed reciprocating piston type compressor.

* * * * *